US006734434B1

(12) United States Patent
Sainty

(10) Patent No.: US 6,734,434 B1
(45) Date of Patent: May 11, 2004

(54) ION SOURCE

(75) Inventor: Wayne G Sainty, Beecroft (AU)

(73) Assignee: Saintech Pty Ltd., Sydney (AU)

( * ) Notice: Subject to any disclaimer, the term of this patent is extended or adjusted under 35 U.S.C. 154(b) by 0 days.

(21) Appl. No.: 09/744,205

(22) PCT Filed: Jul. 21, 1999

(86) PCT No.: PCT/AU99/00591

§ 371 (c)(1),
(2), (4) Date: Jan. 18, 2001

(87) PCT Pub. No.: WO00/05742

PCT Pub. Date: Feb. 3, 2000

(30) Foreign Application Priority Data

Jul. 21, 1998 (AU) ..... PP4792

(51) Int. Cl.[7] ..... H01J 49/10
(52) U.S. Cl. ..... 250/423 R; 250/427; 313/111.81
(58) Field of Search ..... 250/423 R, 427; 313/111.81

(56) References Cited

U.S. PATENT DOCUMENTS 4,135,094 A 1/1979 Hull ..... 250/427
4,703,222 A * 10/1987 Yoshikawa et al. ..... 313/362.1
4,760,262 A 7/1988 Sampayan ..... 250/423 R
4,845,364 A * 7/1989 Alexander et al. ..... 250/423 R
4,862,032 A 8/1989 Kaufman ..... 313/359.1
5,656,819 A * 8/1997 Greenly ..... 250/423 R

FOREIGN PATENT DOCUMENTS

EP 0 249658 A2 12/1987
GB 2 295 268 A 5/1996

* cited by examiner

*Primary Examiner*—Nikita Wells
(74) *Attorney, Agent, or Firm*—Darren Gardner

(57) ABSTRACT

An ion source (10) for producing a beam of ions from a plasma is disclosed. A plasma is created at the center of an annular anode (12) by collisions between energetic electrons and molecules of an ionisable gas. The electrons are sourced from a cathode filament (11) and are accelerated to the anode (12) by an applied electric potential. A magnetic field having an axis aligned with the axis of the anode acts to concentrate the flow of electrons to the center of the anode (12). The ionisable gas is introduced into the ion source (10) at the point of concentrated electron flow. Ions created in the resultant plasma are expelled from the ion source as an ion beam centered on the axis of the magnetic field. The surfaces of the anode are coated with an electrically conductive non-oxidising layer of Titanium Nitride to prevent a build up of an insulating layer on the anode.

4 Claims, 3 Drawing Sheets

ION SOURCE

BACKGROUND OF THE INVENTION

This invention relates to ion sources for producing an ion beam. The invention was developed through use with end-Hall effect ion sources and is, at times, described with particular reference thereto. It will be apparent to the skilled reader however, that the scope of the invention will encompass other types of ion sources.

Ion sources had their origins in space propulsion but more recently have found use in more industrial processes such as Ion Assisted Deposition (IAD) of thin film coatings. In an IAD process, an ion beam from an ion source is focussed onto a target substrate to cause densification of the coating material as it is deposited. The process occurs within an evacuated chamber of pressure of the order $10^{-2}$Pa.

In a typical ion source, electrons are drawn from a cathode filament toward an anode through an ionisable gas. Collisions between the gas molecules and energetic electrons create a source of positive ions by inducing a plasma. In one type of ion source known as a gridless ion source, a magnetic field is applied across the plasma to shape the ions accelerated from the ion source into an ion beam. In a specific type of gridless ion source, known as an end-Hall effect ion source, the axis of the magnetic field is aligned with the electric potential between the cathode and the anode. The interaction of the magnetic and electric fields causes the charged particles to approximately follow the magnetic field lines. The anode in these devices is typically annular having an outwardly inclined inner diameter with the bulk of the plasma forming within the confines of the anode walls.

An example of the an end-Hall effect ion source in common use, in particular in IAD techniques, is described in U.S. Pat. No. 4,862,032 to Kaufman et al. In this device, herein referred to as the Kaufman device, the ionisable gas is distributed uniformly across the plasma region. Magnetic field shaping disperses the electrons across the gas to ensure a large plasma capable of producing a high ion beam current. The result is that a relatively high gas flow (typically up to 50 sccm) is required to maintain a sufficient pressure in the plasma region to achieve ionisation of the gas. The resultant high background pressure within the interelectrode space creates electrical instability leading to the generation of cathode spots within the ion source and extending to the extremities of the vacuum environment. In addition, large vacuum pumps are required to maintain a sufficiently low pressure within the rest of the evacuated chamber to be compatible with the operation of other equipment used in IAD and other processes. In operation the pressure can only be increased to the point where the ion beam current is approximately 1 Amp before further instabilities are introduced.

A further problem with present ion sources is that their performance can decrease over the life of the ion source. Symptoms include difficulty in establishing the plasma and a reduced stability of the plasma. Investigations by the present inventor have found that the reduced performance capabilities are created, at least in part, by a decrease in the electron flux entering the ionisation region due to a reduction in the effective surface potential of the anode. Further investigation into the cause of the reduced potential by the present inventor found that a dielectric oxide layer built up on the surface of the anode exposed to the plasma. It was previously believed that the observed build up of electrically insulating coatings on the anode were produced by scattering and sputtering from the thin film deposition processes for which these ion sources were commonly used. The inventor has found that the dielectric layer actually arises from a small percentage of negative ions produced in an oxygen plasma interacting with the surface of the anode and that this has the effect of shielding the anode from the cathode, dispersing the electron flow from the cathode and thus reducing the electron flux into the ionisation region. The reduced electron flux into the ionisation region firstly creates instability in the performance of the ion source and, secondly, causes an imbalance in the change neutrality of the resultant ion beam.

SUMMARY OF THE INVENTION

In a first form, the present invention resides in an ion source including a cathode, an anode, an ionisation region between said cathode and said anode, means for introducing an ionisable gas into said ionisation region, means for creating a potential difference between said cathode and said anode to produce a flow of electrons from said cathode toward said anode, said electron flow passing substantially through said ionisation region and causing ionisation of said gas, means for concentrating said electron flow to create a region within said ionisation region where the electron flux is a maximum, and means acting to expel ions created in said ionisation region from said ion source, wherein said ionisable gas is introduced into said ionisation region at a localised area in proximity to said region of maximum electron flux.

Preferably the concentration of electrons and the expulsion of ions from the ion source is achieved using a magnetic field.

More preferably, the axis of the magnetic field lies substantially parallel to the direction of the electric potential between the anode and the cathode. With the magnetic and electric fields aligned in this way, the maximum electron flux occurs at the maximum magnetic field intensity.

The invention also provides an ion source including a cathode, an anode, an ionisation region between said cathode and said anode, means for introducing an ionisable gas into said ionisation region, means for creating a potential difference between said cathode and said anode to produce a flow of electrons from said cathode toward said anode, said electron flow passing substantially through said ionisation region and causing ionisation of said gas, and means acting to expel ions created in said ionisation region from said ion source, wherein said anode has at least one surface exposed to said ionisation region, at least a portion of said at least one exposed surface being of an electrically conducting non-oxidising material.

Preferably the anode is annular having an axis lying in the same direction as the electric field between the anode and the cathode. The exposed surfaces of the anode are preferably a coating of Titanium Nitride (TiN).

BRIEF DESCRIPTION OF THE DRAWINGS

Further features and advantages of the invention will become apparent to the skilled reader from the following description of preferred embodiments made with reference to the accompanying Figures in which.

DESCRIPTION OF PREFERRED EMBODIMENTS

Figure 1:
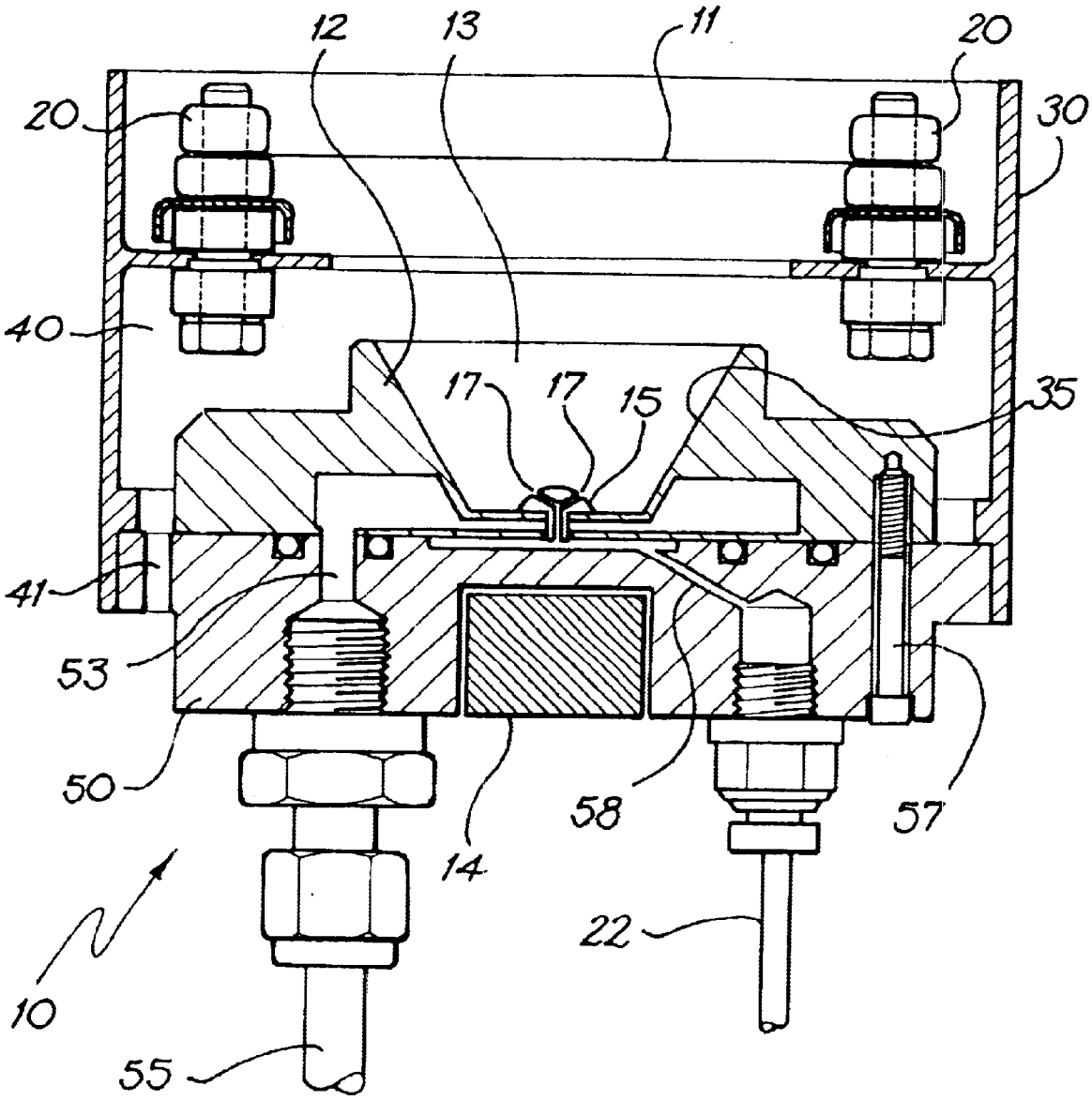
FIG. 1 is a partial cross-sectional elevation of the ion source according to the invention.
Figure 2:
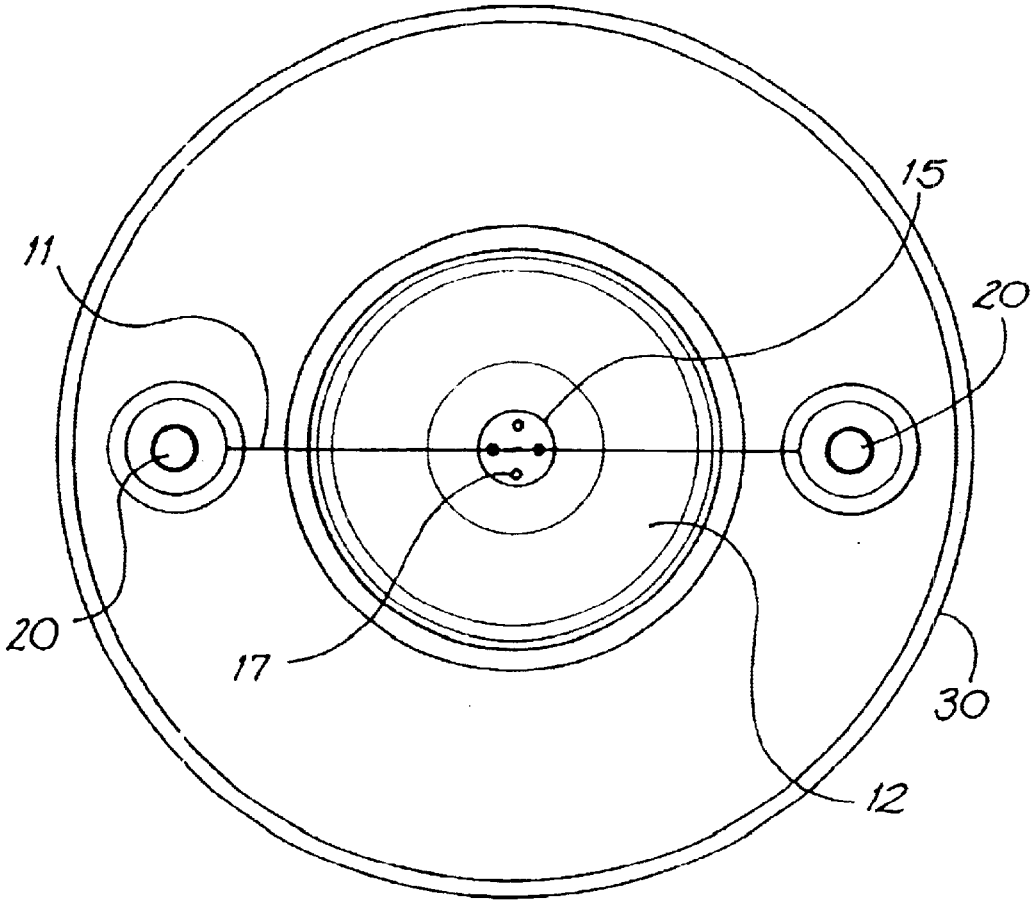
FIG. 2 is a plan view of the ion source in FIG. 1.

FIGS. 1 and 2 show an ion source generally at 10 having a cathode wire 11 and an anode 12. The anode 12 is an annulus having an inner surface 35 sloping outwards in the direction of the cathode. Between the cathode 11 and the anode 12 is an ionisation region 13. The cathode wire 11 is suspended above the anode by two mounting pins 20 that are held by, and in electric isolation from a shield plate 30. The shield plate 30 substantially surrounds the anode, cathode and ionisation region by extending from a point lower than the anode 12 to a point above the cathode 11 and is preferably maintained at earth potential to shield the anode and the cathode from external fields. A magnet 14 is disposed outside the ionisation region 13 but adjacent the anode 12. The magnet 14 creates a magnetic field, longitudinal axis of which is aligned with the axis of the anode 12. The magnet may be a permanent magnet or an electromagnet. Preferably the magnet is a high flux rare earth magnet such as a NdFeB magnet. As an alternative, magnet 14 may be a ring magnet disposed around the anode 12 and ionisation region 13.

The alignment of the magnetic field with the electric field causes electrons emitted by the cathode to approximately follow the magnetic field lines as they move towards the anode. This has the effect of concentrating the flow of electrons toward the axis of the magnetic field. Therefore the region where the magnetic field intensity is a maximum, will also be a region of maximum electron flux.

The ionisable gas, for example oxygen, nitrogen or argon, is supplied to the ionisation region through a gas flow path from gas feed line 22. The gas flow path terminates at an outlet member 15. The outlet member 15 has the form of a gas shower head, with a plurality of apertures 17, that introduce the gas into the ionisation region 13 in a substantially random direction. The gas shower head 15 is disposed on the axis of the anode and adjacent the ionisation region 13 such that gas emanating from the apertures 17 enters the ionisation region at a point of high electron flux. Because a large proportion of ionisation occurs close to the outlet, the gas shower head is of a material such as stainless steel, that withstands the very high energy from the incoming electron flux.

The anode 12 preferably has disposed within it a channel 53 in communication with a fluid conduit 55 that provides water to cool the anode. The channel 53 preferably extends into the body of the outlet member 15.

The anode 12, outlet member 15 and shield 30 are mounted on a non conductive mounting base 50 through which extends the gas flow path and fluid conduit 55. A plurality of mounting screws 57 fix the anode 12 to the base 50. The magnet 14 is housed within the base such that the external pole is exposed. The mounting base 50 has a conduit 58 that forms part of the gas flow path and connects the gas feed line 22 to the outlet member 15 such that no electrical connection can be made between the outlet member 15 and the gas feed line 22. The mounting base 50 has a similar conduit for connecting the water feed line 55 to the channel 53. The gas and water feed lines preferably screw into the mounting base 50. A suitable material for the mounting base 50 is glass filled polytetrafluoroethylene. This arrangement reduces electrical hazards, simplifies mounting and installation and reduces risk of secondary plasmas forming within the gas feed line.

The size of the outlet is preferably half or less than the smallest inner diameter of the anode in order that a localised high pressure zone is created around the outlet, that decreases rapidly with distance.

In operation the anode is charged in the range 0–500 V preferably 250 V relative to the cathode which is at or near earth potential. A DC current of approximately 12A is passed through the cathode to stimulate electron emission. An AC current may be used but the combination of an alternating current and the magnetic field has been found to cause vibrations in the cathode which reduces the cathode lifetime. Electrons generated at the cathode are influenced by the anode potential and are accelerated toward it. The magnetic field imparts a spiral motion on the electrons further increasing their potential to ionise gas molecules and focussing the electrons toward the longitudinal axis. Collisions between the energetic electrons with gas molecules emitted from the outlet member 15 cause ionisation. If sufficient ionising collisions occur then a plasma is formed. Positive ions created in the plasma experience the opposite effect to the electrons. The ions initially have a random velocity but are influenced by the potential gradient which accelerates them toward and past the cathode 11. The magnetic field in this case acts to control the direction in which the ions are expelled from the ion source by focusing them into an ion beam centred on the longitudinal axis of the magnetic field. The dynamics of the interactions between the ions and the electric and magnetic fields for this configuration are known per se, for example from the above mentioned Kaufman patent. The current of the ion beam is effected by the size of the plasma which can be controlled by the gas flow rate.

The plasma can be maintained for a wider range of gas flow rates than for prior art ion sources because there is always at least a localised region of high pressure. The range of gas flows gives a corresponding range in the ion beam currents. A further advantage is that lower gas flow rates are required to achieve the equivalent or higher beam currents than for prior art devices. For example a gas flow rate of 4–5 sccm can achieve a beam current of 2 A in the present invention compared with 10–50 sccm required to produce 1 A of beam current in devices of the above mentioned Kaufman type. These lower gas flow rates assist in allowing a low background pressure to be maintained.

A further benefit of reduced flow rate is that the operational requirements of the vacuum pumping system used to evacuate the chamber in which the ion source is disposed can be reduced, while still maintaining lower background pressures than achieved in many prior art devices. This increases stability by reducing the chances of arcing and sputtering in the peripheral regions of the ion source.

Operating background pressures of the order $10^{-3}$ Pa have been achieved with the present invention. At these pressures the mean free path of the ions is of the order of metres. This is important in many ion source applications because it is typically many times longer then the dimensions of the vacuum environment. For IAD processes, mean free paths of this order are longer than the typical distance between the ion source and the target substrates. The efficiency of the deposition process is therefore enhanced by these low background pressures because more primary ions impact the target substrates instead of undergoing secondary collisions with gas molecules. A further benefit of the reduced pressure is that contamination of the thin film coating, is considerably reduced.

The anode 12 is preferably made of stainless steel but has a coating of a non-oxidising electrically conductive material, for example TiN, on the inner surface 35 and any other surface that in use may be exposed to bombardment by electrons and/or negative ions from the plasma. The inner surface coating is unreactive with any negative ions produced in the plasma and therefore resists the build up of a dielectric layer on the anode surface. This provides a long term benefit in the performance of the ion source because a dielectric coating would shield the anode potential from the cathode. This would reduce the concentration of electrons flowing into the ionisation region, thus reducing the size of the plasma and in turn the ion beam current. In addition, the concentration of electrons in peripheral regions of the ion source would increase, thereby increasing the frequency of arcing and sputtering in these regions. By coating the anode in a non-oxidising material, these problems can be eliminated as can the cleaning procedures previously required to maintain the anode in working order.

Figure 3:
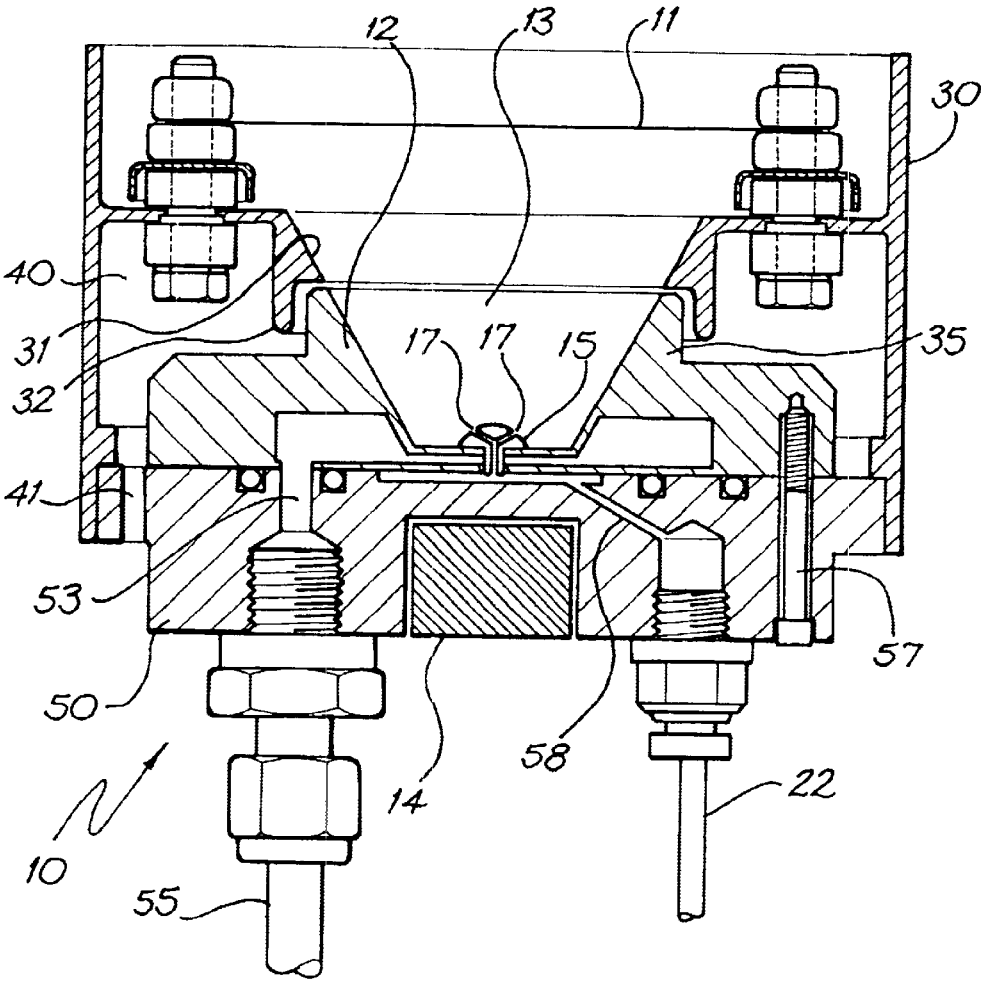
FIG. 3 is a cross-sectional view of a preferred form of the invention.

Because the ion source 10 operates at a low background pressure the anode and cathode can be in closer proximity than in previous devices. FIG. 3 shows a preferred form of the invention where the inner edge 31 of the plasma shield 30 extends towards the anode 12. Preferably the inner edge 31 of the shield 30 is disposed outside a projection of the inner surface 35 of the anode 12. The extended edge 31 has a flange 32 that surrounds an upper portion of the anode 12. The purpose of the flange 32 is to prevent gas entering the region 40 enclosed by the anode 12 and shield 30 where the gas could be ionised and cause electrical instability. A vent hole 41 is provided from the region 40 to outside the ion source to allow sufficient pumping of this region, thus ensuring a low pressure To further prevent any instabilities an o-ring seal (not shown), preferably of an elastomer material, can be disposed between the flange 32 and an upper portion of the anode 12.

While particular embodiments of this invention have been described, it will be evident to those skilled in the art that the present invention may be embodied in other specific forms without departing from the essential characteristics thereof. The present embodiments and examples are therefore to be considered in all respects as illustrative and not restrictive, the scope of the invention being indicated by the appended claims rather than the foregoing description, and all changes which come within the meaning and range of equivalency of the claims are therefore intended to be embraced therein.

What is claimed is:

1. An ion source including a cathode, and anode, and ionisation region between said cathode and said anode, means for introducing an ionisable gas into said ionisation region, means for creating a potential difference between said cathode and said anode to produce a flow of electrons form said cathode toward said anode, said electron flow passing substantially through said ionisation region and causing ionisation of said gas, and means acting to expel ions created in said ionisation region from said ion source, wherein said anode has at least one surface exposed to said ionisation region, at least a portion of said at least one exposed surface comprising a layer of Titanium Nitride.

2. An ion source according to claim 1 wherein said anode is annular and includes an inner surface sloping outwards in the direction of said cathode, said inner surface being exposed to said ionisation region and at least a portion of said inner surface comprising a layer of Titanium Nitride.

3. An ion source according to claim 2 wherein substantially the entire inner surface of said anode is comprised of a layer of Titanium Nitride.

4. An ion source according to claim 2 wherein said gas introducing means includes an outlet member disposed substantially at the centre of said anode, said outlet member having a surface comprising a layer of Titanium Nitride.

* * * * *